US007367412B2

(12) United States Patent
Barbera et al.

(10) Patent No.: US 7,367,412 B2
(45) Date of Patent: May 6, 2008

(54) COLLAPSIBLE ROCK HEAD

(76) Inventors: Anthony R. Barbera, 2280 Rio Grande Cir., SE., Massillon, OH (US) 44646; David M. Barbera, 10104 Hollingsworth Ave., Bolivar, OH (US) 44612

( * ) Notice: Subject to any disclaimer, the term of this patent is extended or adjusted under 35 U.S.C. 154(b) by 191 days.

(21) Appl. No.: 11/412,029

(22) Filed: Apr. 26, 2006

(65) Prior Publication Data

US 2007/0251730 A1 Nov. 1, 2007

(51) Int. Cl.
*E21B 10/44* (2006.01)
*E02D 29/05* (2006.01)

(52) U.S. Cl. ..... 175/274; 175/323; 175/62; 175/258; 175/366; 299/107

(58) Field of Classification Search ..... 175/62, 175/257, 258, 267, 269, 263, 274, 284, 291, 175/331, 323, 356, 355, 366, 292, 378, 342; 299/73, 74, 85.1, 106, 107, 110
See application file for complete search history.

(56) References Cited

U.S. PATENT DOCUMENTS 3,545,811 A * 12/1970 Montacie ..... 299/56
3,561,550 A * 2/1971 Mays ..... 175/271
3,583,503 A * 6/1971 Coski ..... 175/313
3,837,413 A * 9/1974 Dunn ..... 175/292
3,934,660 A * 1/1976 Nelson ..... 175/102
5,711,385 A * 1/1998 Brotherton ..... 175/257

* cited by examiner

*Primary Examiner*—Kenneth Thompson
(74) *Attorney, Agent, or Firm*—Sand & Sebolt

(57) ABSTRACT

A rock head for use with an auger borer to bore a passageway through a body of soil and rock and simultaneously laying a pipe in that bored passageway. The rock head has a base connectable to the leading end of the auger. A plurality of movable mounts are provided on the base and a roller cone is secured to each movable mount. A spring is disposed between the movable mount and the base. The spring is compressed as the movable mount pivots the roller cones inwardly toward a central region of the base. This reduces the diameter of the rock head so that it can travel through the bore. Each movable mount is provided with at least one wheel so that it can ride smoothly through the bore. When the rock head exits the pipe, the springs automatically pivots each roller cone outwardly so that at least a portion thereof is disposed beyond the outermost edge of the base. In this second position, the rock head has a greater diameter than the pipe bore and therefore it cannot travel therethrough. When the auger is withdrawn through the pipe, the movable mounts pivot the roller cones from the second position back to the first position, thereby causing the rock head to collapse to a diameter sufficiently small enough to travel back through the pipe.

20 Claims, 14 Drawing Sheets

COLLAPSIBLE ROCK HEAD

BACKGROUND OF THE INVENTION

1. Technical Field

This invention generally relates to boring equipment. More particularly, the invention relates to a cutting head for use in conjunction with boring machines to bore through a body of soil and simultaneously lay an underground pipe. Specifically, the invention relates to a rock head that is collapsed to reduce its diameter so that it can enter and travel through the bore of a pipe and that automatically expands to the original diameter once it exits the pipe.

2. Background Information

When underground pipes are to be laid, it is necessary to dig a hole through the soil to lay the pipe. This presents little problem if the pipe is to be positioned close the surface and there are no structures in the way. Then all that needs to be done is to dig a trench, put the pipe in place and fill the trench with soil. However, as urban development progresses, there is a growing need to be able to lay pipe quickly and efficiently and without causing damage to surface structures such as roadways. This can be accomplished by using a process known as auger boring. In this procedure, a boring machine is used to form a horizontal hole or passageway through the soil at the appropriate depth. If the terrain to be bored is hilly, the boring machine may be positioned proximate a hillside. If the terrain is flat, then an excavation pit is dug into the terrain to position the boring machine at an appropriate depth beneath the surface. In either instance, the boring machine is mounted on tracks so that it is able to slide toward and away from the surface into which the hole is being bored. Once the boring machine is in position, a flighted-auger is operationally connected to the boring machine and an appropriate cutting head is attached to the auger. The cutting head is placed into contact with the soil-face and the auger and cutting head are rotated by the boring machine so that the cutting head bores into the soil-face. As the cutting head cuts through the soil, the auger flights direct the excavated material away from the cutting head, out of the hole and to a location proximate the boring machine. Appropriate means are used to move the excavated soil out of the vicinity of the boring machine. Additional sections of auger are added as needed by sliding the boring machine away from the hole, positioning a new auger section rearwardly of the first auger section using a crane, and then securing the auger sections together. The boring machine is advanced forwardly along the tracks toward the soil-face until the next auger section is needed, and then another auger section is attached thereto. This procedure is repeated until the desired length of hole is cut through the soil.

In order to lay the pipe at the same time as the hole or passageway is excavated. In this instance, each section of auger is inserted into a length of pipe before it is lowered into place in front of the boring machine. The cutting head is then attached to the lead auger section. The cutting head needs to have a diameter that is slightly larger than the outside diameter of the pipe being laid, so that the bored hole is large enough to receive the pipe therethrough. The boring machine then advances both the pipe and auger as the cutting head cuts through the soil. The machine pushes the pipe through the soil, but rotates the auger within the pipe. Subsequent sections of auger and pipe are connected as needed. The sections of auger are connected together using the male and female hex connectors they are provided with. The sections of pipe are secured together by welding.

The cutting head selected for boring operations is dependent upon the type of substrate that is being drilled through. If the substrate is generally soil with small stones interspersed therethrough, then the type of cutting head used is known as a dirt head. Dirt heads cut easily and efficiently through soil. Sometimes, however, during boring operations, the dirt head will strike a large rock or a layer of rock. Dirt heads are ill equipped to cut through rock. In the past, if such an obstacle was encountered, then the first thing that was done was that a hole was dug down from the surface in an attempt to intercept and remove the rock, if possible. If, on the other hand, the rock was found to be too large, then the operators would use the dug hole to gain access to the dirt head, remove it from the front of the auger and replace it with a rock head. Rock heads are specially designed to cut through rock, but are fair less efficient at cutting through soil. Consequently, when the harder obstacle had been bored through, the operators would again have to dig down from the surface and replace the rock head with the dirt head.

If the hole was at too great a depth, then an alternative method of swapping the dirt head and rock head would be for the operators to withdraw the auger, pipe and dirt head from within the bored hole, cut the welds in the pipe as needed and disconnect the auger flights from each other. Then when everything was removed from the hole, the rock head would be attached to the lead auger, the auger would be repositioned in the hole and the boring machine would advance the auger and rock head through the hole until the rock or boulder was reached. The rock head would then be used to drill through the rock, then the auger and rock head would be withdrawn from the hole, the rock head removed, the lead auger repositioned within a pipe section and then the dirt head would be reattached to the lead auger. The dirt head and lead auger would then reinserted into the hole and boring would resume. All of this procedure took a considerable amount of time and effort depending on the length of hole and pipe involved. The time period for this type of exchange could extend to days. Alternatively, if the pipe was large enough, then the operator would simply withdraw the auger and dirt head and send a man with a hammer and chisel down the pipe to chip away at the rock involved. All of these methods of removing or boring through the rock would cost a lot of time, money, and effort and would slow the progress of the boring operation to a considerable extent.

There is therefore a need in the art for a rock head that can be quickly and easily attached to the front of an auger during boring operations that occur some depth from the surface without requiring tunneling down from the surface or removal of already installed sections of pipe and auger.

SUMMARY OF THE INVENTION

The device of the present invention is a rock head A rock head for use with an auger borer to bore a passageway through a body of soil and rock and simultaneously laying a pipe in that bored passageway. The rock head has a base connectable to the leading end of the auger. A plurality of movable mounts are provided on the base and a roller cone is secured to each movable mount. A spring is disposed between the movable mount and the base. The spring is compressed as the movable mount pivots the roller cones inwardly toward a central region of the base. This reduces the diameter of the rock head so that it can travel through the inside of the pipe. Each movable mount is provided with at least one wheel so that it can ride smoothly through the pipe. When the rock head exits the pipe, the springs automatically pivots each roller cone outwardly so that at least a portion thereof is disposed beyond the outermost edge of the base. In this second position, the rock head has a greater diameter than the pipe bore and therefore it cannot travel therethrough. When the auger is withdrawn through the pipe, the movable mounts pivot the roller cones from the second position back to the first position, thereby causing the rock head to collapse to a diameter sufficiently small enough to travel back through the pipe.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
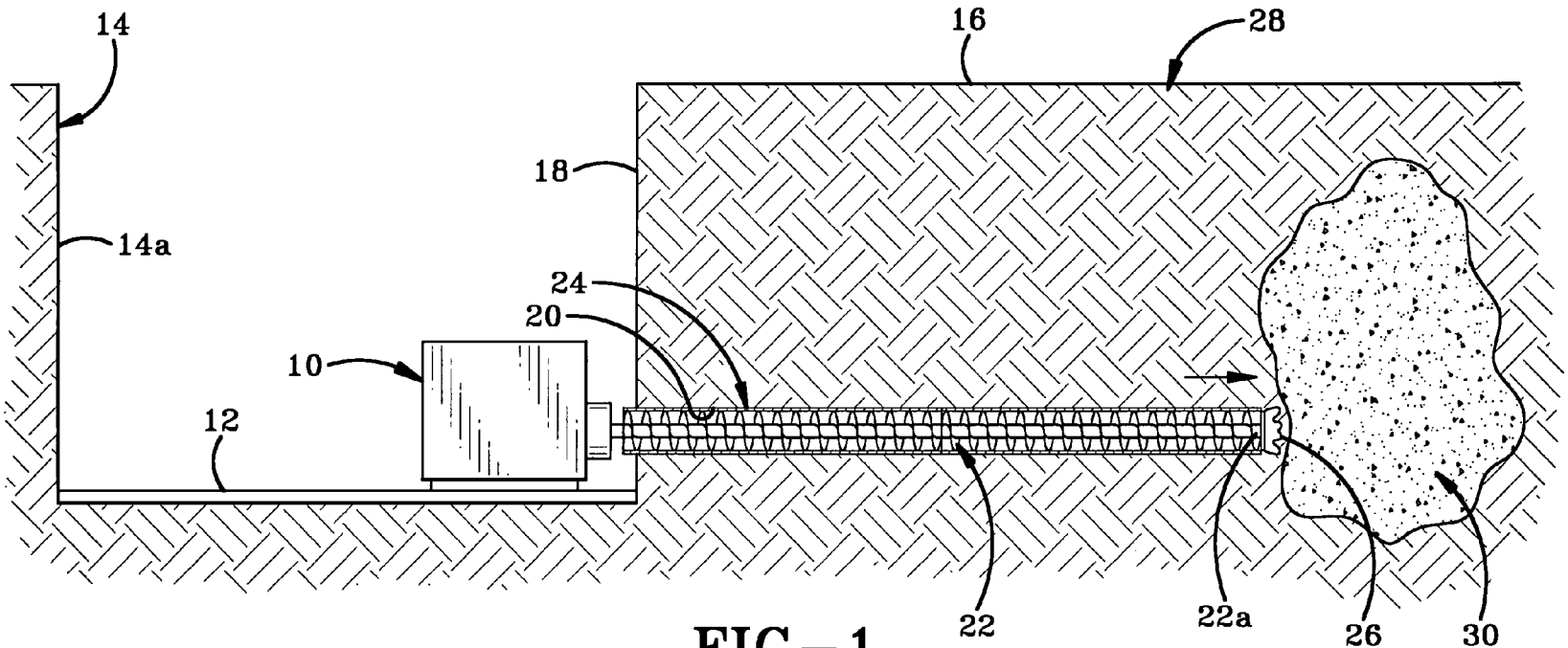
FIG. 1 is a front elevational view showing a boring machine equipped with a dirt head encountering a rock.

Referring to FIG. 1, there is shown a boring machine 10 mounted on tracks 12 within an excavation pit 14. Pit 14 extends for a depth below the surface 16 and exposes a soil-face 18 into which a hole 20 is being bored. The boring is accomplished by a dirt head 26 that is attached to a front end 22*a* of a flighted-auger 22. Auger 22 is operationally connected to boring machine 10 and extends through the bore 32 of a casing or pipe 24. Boring machine 10 advances both the auger 22 and pipe 24 through the soil 28. FIG. 1 illustrates that a large-bodied rock 30 lies in the path of the dirt head 26. Inasmuch as the dirt head 26 is not suitable for boring through hard substances such as rock, dirt head 26 has to be replaced with a rock head (not shown in this Figure).

Figure 2:
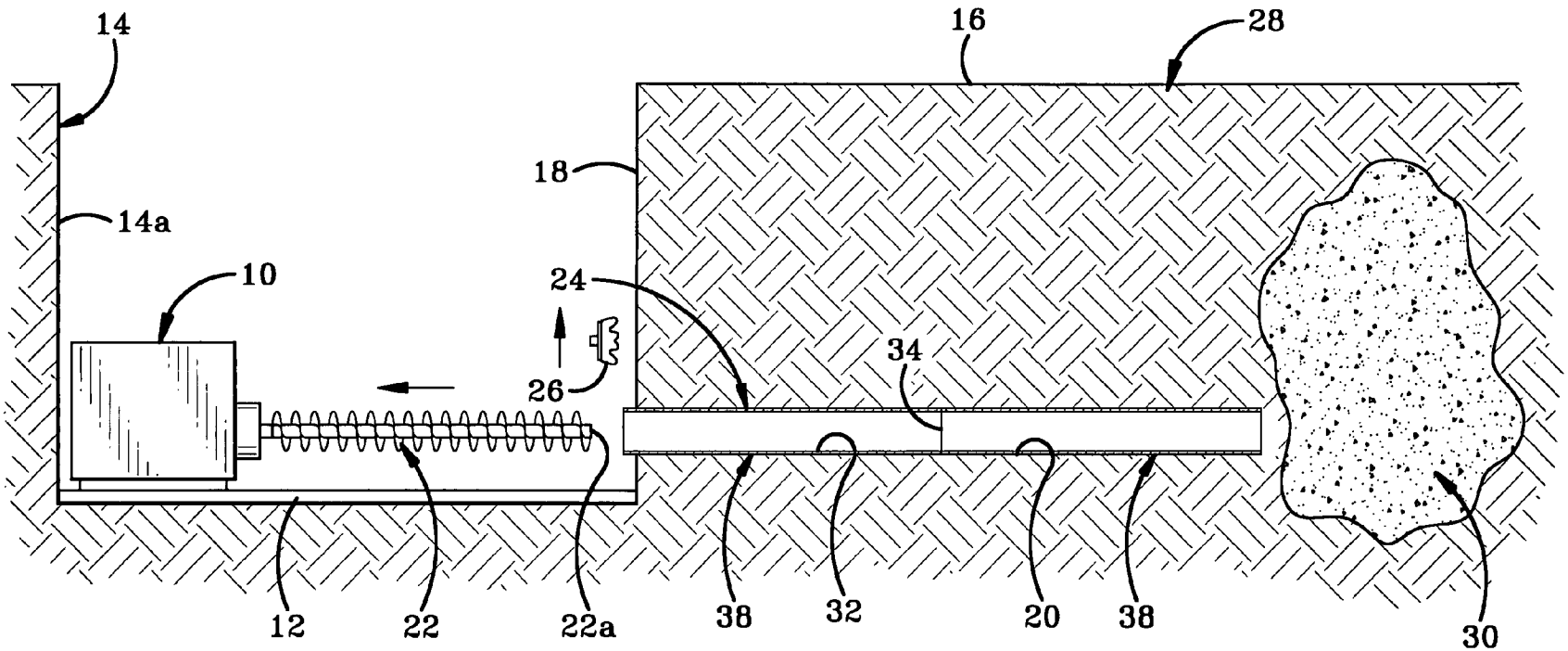
FIG. 2 is a front elevational view showing the boring machine with the auger extracted out of the pipe and with the dirt head removed.

In order to replace dirt head 26 with a cutting head suitable for cutting through the rock 30, the auger 22 and dirt head 26 have to be withdrawn from within bore 32 of pipe 24. FIG. 2 illustrates how boring machine 10 is slidably moved rearwardly on tracks 12 toward the back side of excavation pit 14 and remote from soil-face 18. As boring machine 10 moves rearwardly, it draws auger 22 and dirt head 26 rearwardly and out of bore 32 of pipe 24. The figure also illustrates that pipe 24 comprises a plurality of sections, such as first and second sections 36, 38 that are connected by a weld 34. Once auger 22 is fully withdrawn from pipe 24, then dirt head 26 is detached from the front end 22*a* of auger 22. All of the steps described thus far are known in the prior art and are commonly practiced.

In accordance with a specific feature of the present invention, there is provided a collapsible rock head 40 for attachment to front end 22*a* of auger 22. Rock head 40 is shown in detail in FIGS. 3-7. Rock head 40 comprises a substantially planar base 42 having a front surface 42*a* and a rear surface 42*b*. A male hex connector 48 extends outwardly away from rear surface 42*b* of base 42. Hex connector 48 is complementary sized and shaped to be received within a female hex connector 50 that extends outwardly from the front end 22*a* of auger 22. As may be most easily seen from FIG. 3A, base 42 includes a central region 52 that preferably has six wings 54 radiating outwardly away therefrom. The V-shaped gaps that are formed between adjacent wings 54 are provided so as to allow material excavated by the rock head 40 to be fed rearwardly onto the flights 22*b* (FIG. 3) of auger 22.

A plurality of drill bits are mounted on front surface 42*a* of base. The first group of drill bits is a tri-cone group 56 of roller cones that is fixedly mounted on central region 52. The second group of drill bits 58 are each fixedly mounted on alternate wings 54 of base 42. The third group comprises a plurality of drill bits 60 which are movably-mounted on wings 54 that alternate with those upon which drill bits 58 are mounted.

Figure 3:
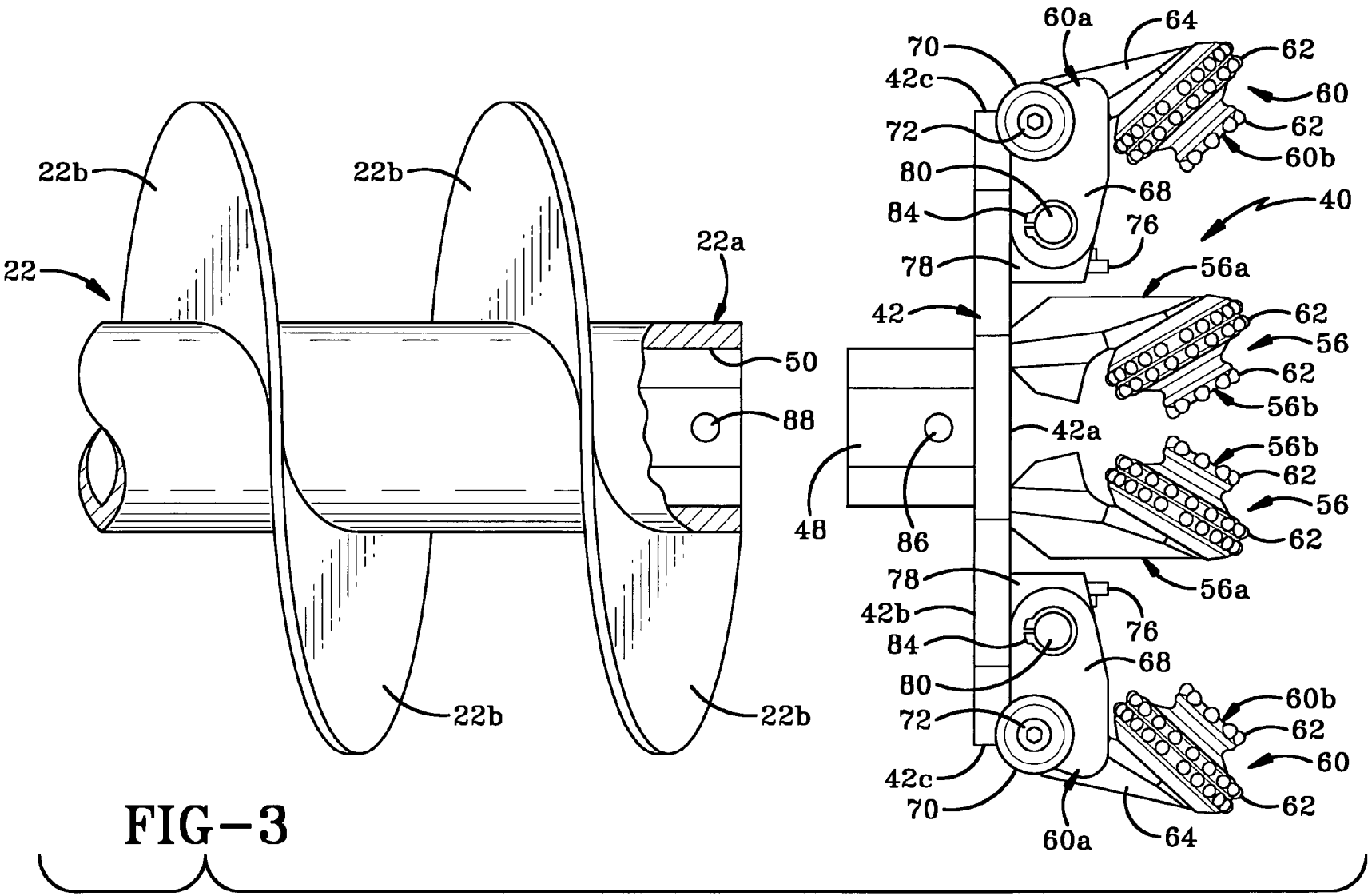
FIG. 3 is a front elevational view of the front end of the lead auger and of a rock head in accordance with the present invention being positioned for attachment thereto.
Figure 3A:
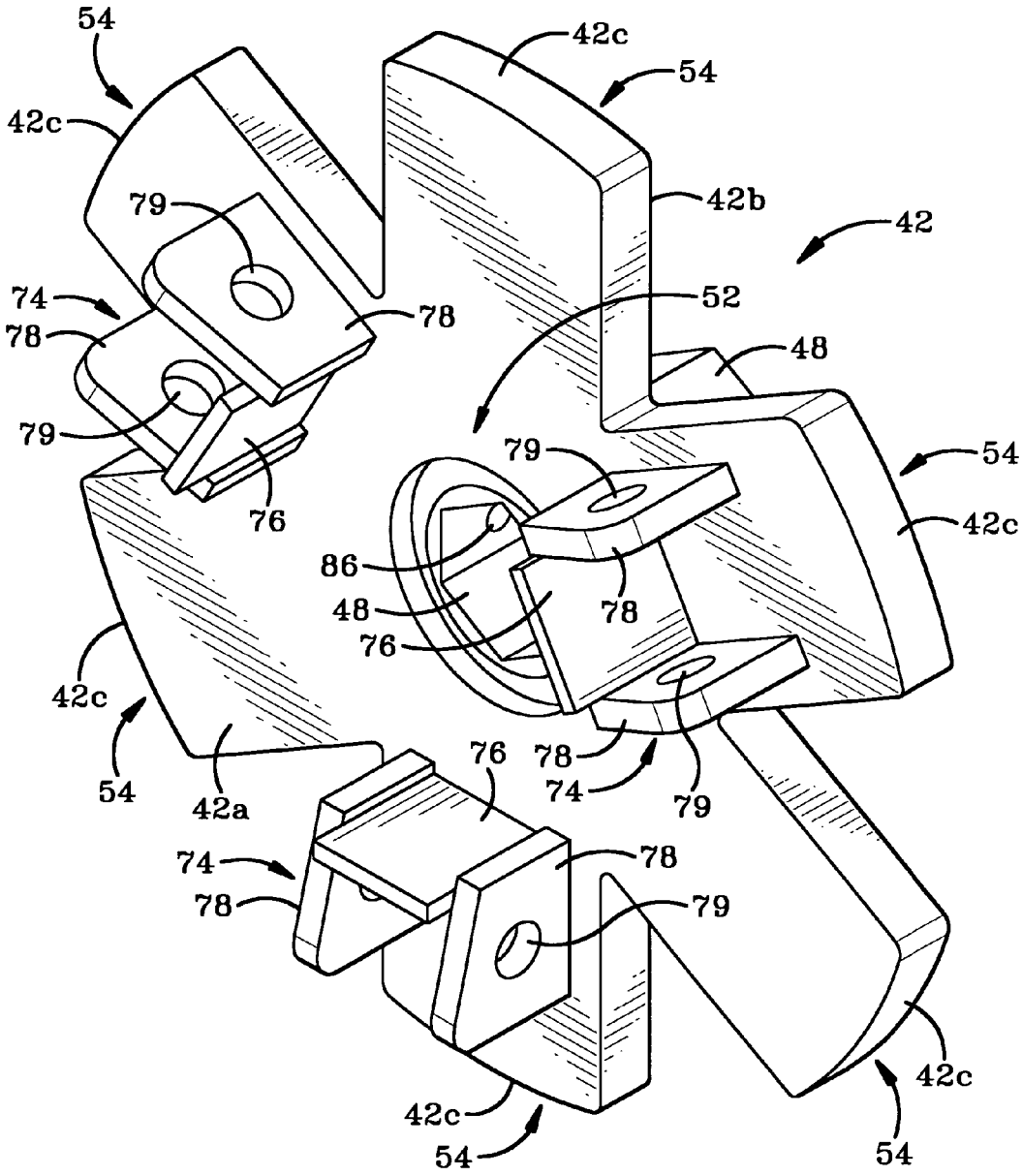
FIG. 3A is a perspective view of the base onto which the movable roller cones are mounted.

Referring to FIG. 3, each of the drill bits 56, 58, 60 is comprised of two components, namely a body and a roller cone rotatably mounted upon the body. So, the drill bits in the tri-cone group 56 each have a body 56*a* and a roller cone 56*b* mounted thereupon. The roller cone includes a plurality of cutting and grinding surfaces 62 which are made of any material sufficiently hard enough to fragment and crush rock, such as steel or tungsten. The exact structure of tri-cone group 56 is well known in the art. The bodies 56*a* of the drill bits in the tri-cone group 56 are fixedly mounted to base 42.

Drill bits 58 have a body (not shown) and a roller cone 58*b* (FIG. 5) rotatably mounted thereupon. The bodies of drill bits 58 are fixedly mounted to alternate wings 54 of base 42. As is the case with drill bits 56, the roller cones 58*b* include a plurality of cutting and grinding surfaces 62 thereon.

Drill bits 60 each comprise a body 60*a* and a roller cone 60*b* rotatably mounted thereon. Each roller cone 60*b* includes a plurality of cutting and grinding surfaces 62. Unlike drill bits 56 and 58, the bodies 60*a* of drill bits 60 are mounted to be movable between a first position (shown in FIGS. 6A & 7) where the roller cone 60*a* is positioned inwardly of the outermost edge 42*c* of base 42; and a second position (shown in FIGS. 4A & 5) where the roller cone 60*b* is positioned at least partially outwardly beyond the outermost edge 42*c* of base 42. Body 60*a* includes an upwardly extending leg 64, a front wall 66, and a pair of spaced-apart side walls 68 which straddle leg 64 and front wall 66. Leg 64 and walls 66, 68 are connected together in any suitable manner so that they move as a unit. Each body 60*a* is secured to a mounting bracket 74 (FIG. 3A) disposed on one of the alternate wings 54 on base 42. Mounting brackets 74 are welded or otherwise attached to front surface 42*a* of base 42. Each mounting bracket 74 includes an inner wall 76 and a pair of side walls 78. The spacing between the exterior surfaces of side walls 78 preferably is substantially equal to the spacing between the interior surfaces of side walls 68. Side walls 68 are each provided with an aperture (not shown) and side walls 78 are each provided with provided with a hole 79 therethrough. When body 60*a* is to be connected to mounting brackets 74, the side walls 68 of body 60*a* are positioned outwardly of side walls 78 and the apertures and holes 79 are brought into alignment with one another. The apertures and holes 79 are sized to receive a retaining pin 80 therethrough. Each retaining pin 80 is inserted through a first aligned aperture and hole 79, through a spring 82, and then through the other aligned aperture and hole 79. A snap ring 84 is then inserted into a groove (not shown) formed proximate each end of each pin 80. Snap rings 84 prevent retaining pins 80 from being withdrawn from the aligned apertures and holes 79. Retaining pin 80 locks body 60*a* to mounting bracket 74 in such a way that body 60*a* is able to pivot about retaining pin 80, thereby making drill bit 60 movable relative to base 42.

Figure 4:
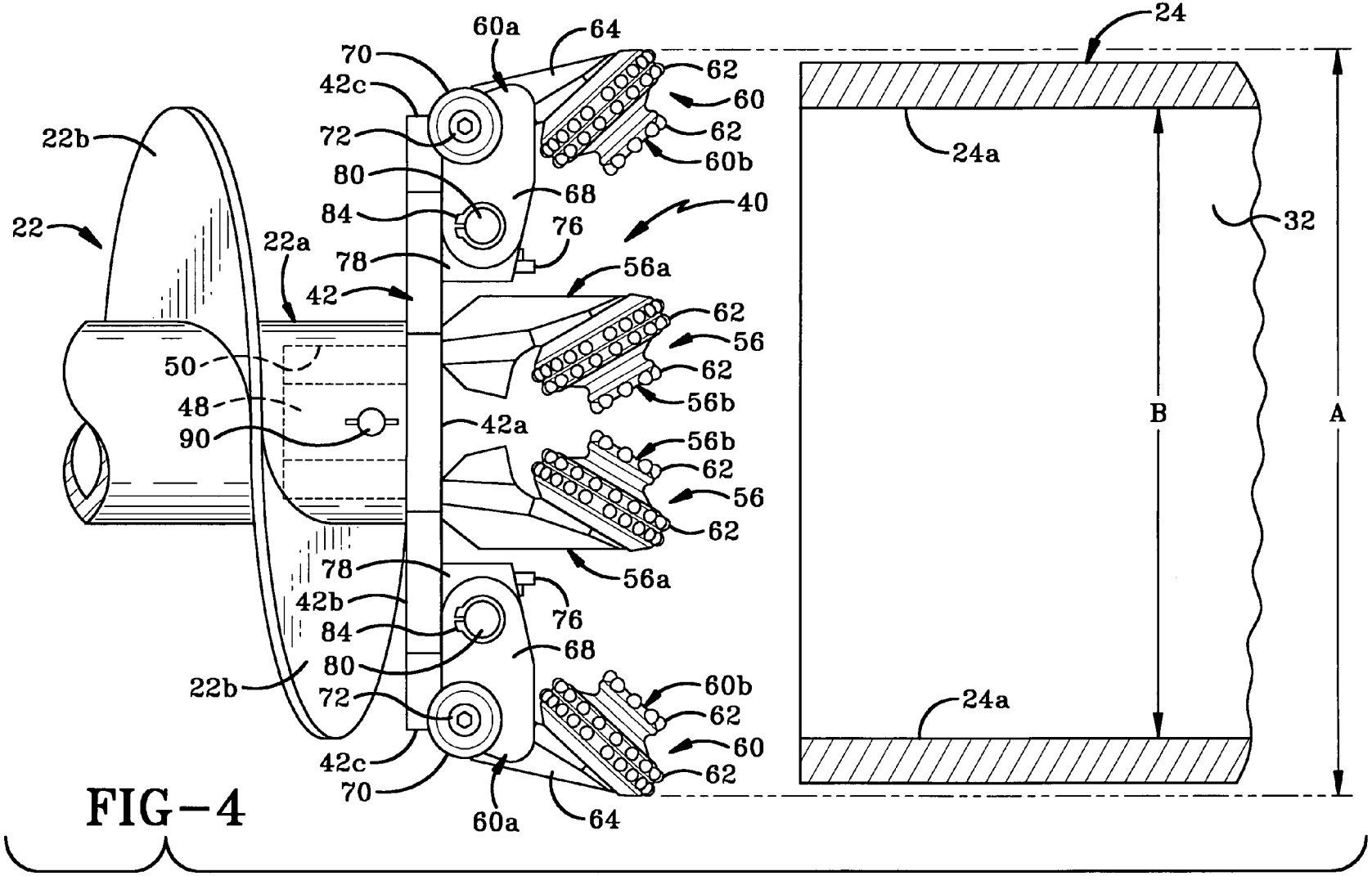
FIG. 4 is a front elevational view of the front end of the lead auger with the attached rock head being brought into the proximity of the back end of the pipe and showing the external diameter of the rock head exceeding the internal diameter of the pipe.
Figure 4A:
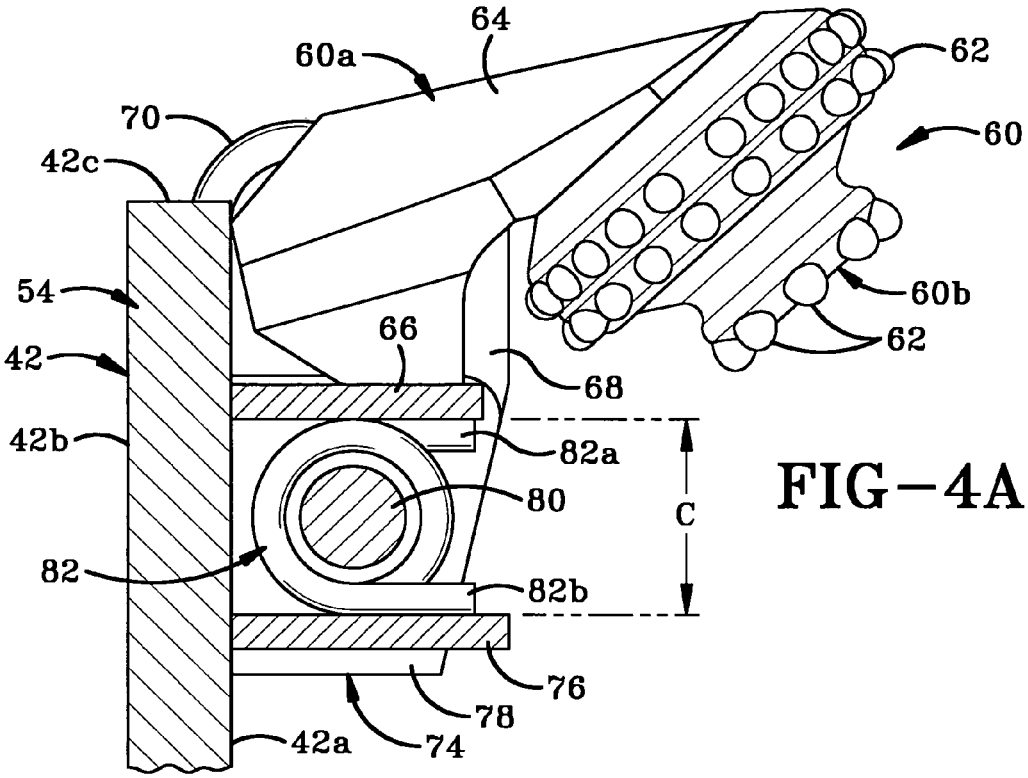
FIG. 4A is an enlarged cross-sectional view of the upper pivoting roller cone of the rock head with the side wall thereof removed to show the spring.
Figure 6A:
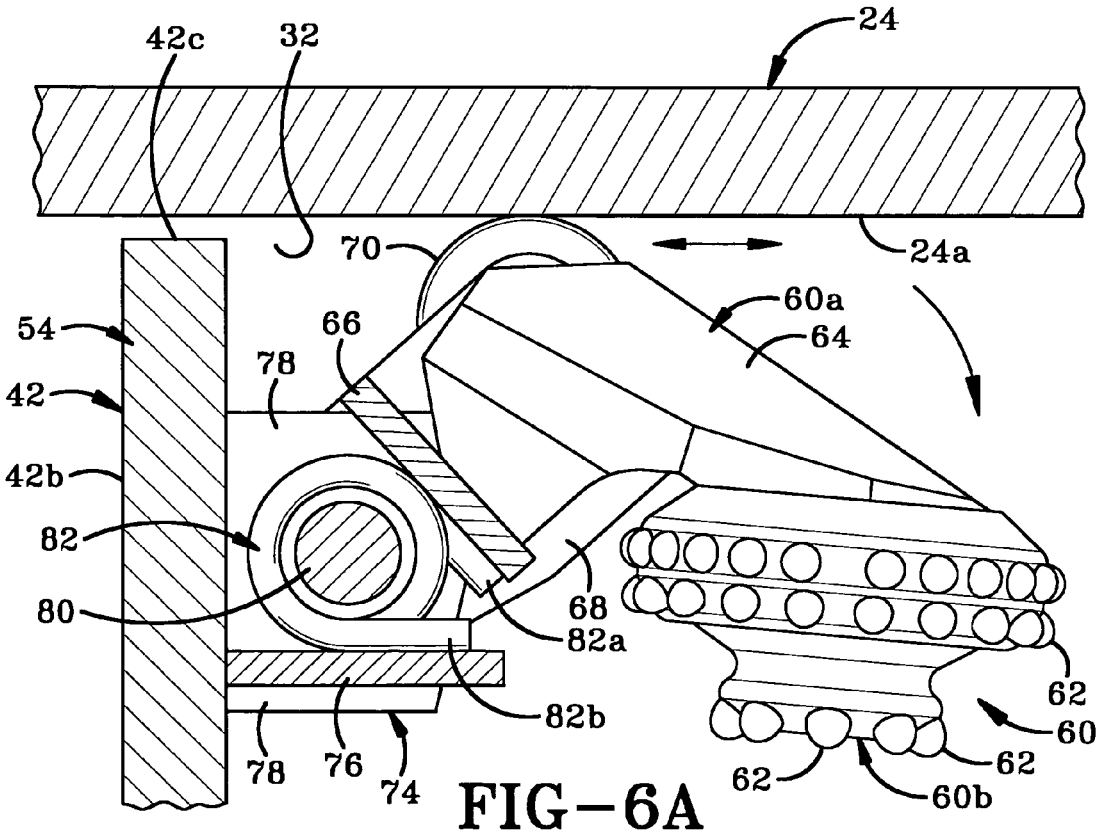
FIG. 6A is an enlarged cross-sectional view of the upper pivoting roller cones riding on the wheels through the bore of the pipe.

As may be most easily seen in FIGS. 4A and 6A, drill bits 60 are spring-biased, each being mounted with a spring 82 has a first end 82*a* that abuts front wall 66 of drill bit 60 and a second end 82*b* that abuts inner wall 76 of mounting bracket 74. Spring 82 is so positioned that as body 60*a* of drill bit 60 pivots about retaining pin 80, the first end 82*a* of spring is forced inwardly toward the second end 82*b* thereof, thereby causing compression in the spring. Spring 82 is maintained in this manner when rock head 40 is inserted into pipe 24, but as soon as rock head 40 exits pipe, the spring 82 returns to its original shape and position, thereby causing drill bit 60 is move in the opposite direction and into its second position.

A wheel 70 is preferably mounted onto the outside of each side wall 66 by way of a pin 72. Wheels 70 are positioned to engage an interior surface 24*a* of pipe 24 so as to enable rock head 40 to be pushed or pulled more easily through bore 32 of pipe. Wheels 70 act as guides for rock head 40, keeping it centered in pipe 24. As may be seen from FIGS. 4A & 6A, wheels 70 extend at least partially beyond an outermost edge 42*c* of base 42 whether drill bits 60 are in a first expanded position (FIG. 4A) or in a second collapsed position (FIG. 6A).

Referring to FIGS. 3-11, rock head 40 is used in the following manner. Male hex connector 48 is inserted into female hex connector 50 on front end 22*a* of auger 22. Hex connector 48 includes a first aperture 86 therein and hex connector 50 includes a second aperture 88 therein. When first and second apertures 86, 88 are aligned with one another, a connector pin 90 is inserted therethrough to lock hex connectors 48, 50 together and prevent them from inadvertently separating from each other. The connection made is secure enough to ensure that any rotational motion in auger 22 will be transmitted through to rock head 40 and that rock head 40 will not become detached as it bores through rock 30.

Figure 5:
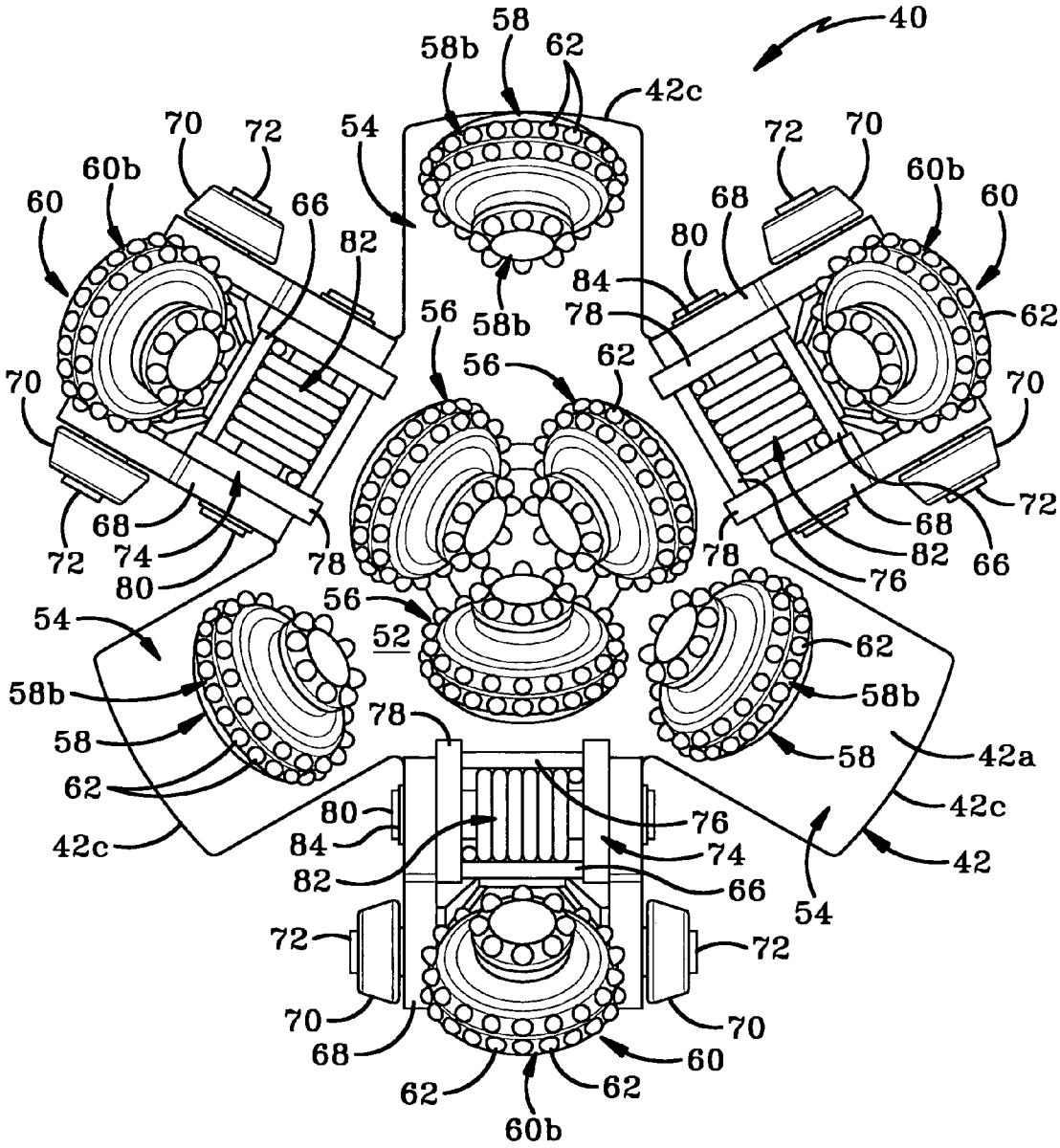
FIG. 5 is an end view of the rock head in the second position.
Figure 6:
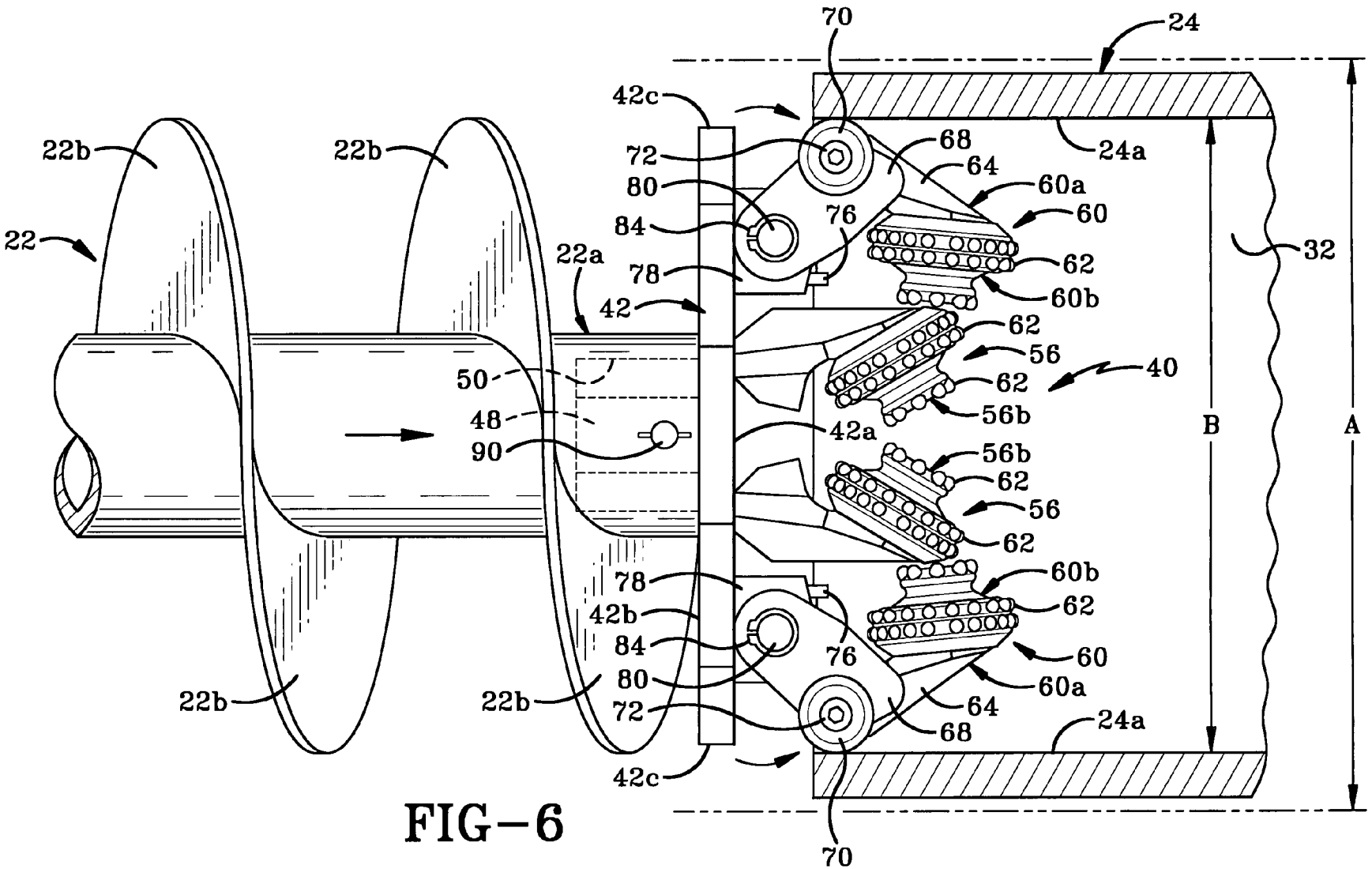
FIG. 6 is a front elevational view of the front end of the lead auger and rock head showing the roller cones pivoting inwardly as the rock head enters the bore of the pipe.

FIGS. 4, 4A & 5 show rock head 40 in its second position, this being the configuration of the cutting head prior to its insertion into pipe 24 and after it has exited from pipe 24. In this second position, the roller cones 60*b* of drill bits 60 extend at least partially beyond the outermost edge 42*c* of base 42, thus causing rock head 40 to have an external diameter "A". Diameter "A" is greater than the diameter "B" of the bore 32 of pipe 24. When rock head 40 is in this second position with a portion of drill bits 60 extend beyond outermost edge 42*c*, the first and second ends 82*a*, 82*b* of spring 82 are disposed a distance "C" apart from each other.

When rock head 40 is to be introduced into bore 32, the diameter of rock head 40 has to be reduced. This is accomplished by moving or pivoting the body 60*a* of each drill bit 60 about retaining pin 80 (FIG. 6A). As body 60*a* pivots, the first and second ends 82*a*, 82*b* of spring 82 are compressed toward each other by the movement of front wall 66 toward inner wall 76. This movement causes roller cone 60*b* of each drill bit 60 to move inwardly toward the central region 52 of base 42, thus causing the overall outer diameter of rock head 40 to be reduced from "A" to slightly less than "B". The pivotal movement of body 60*a* also places springs 82 under compression and allows wheels 70 to be brought into contact with the interior surface 24*a* of pipe 24.

Figure 7:
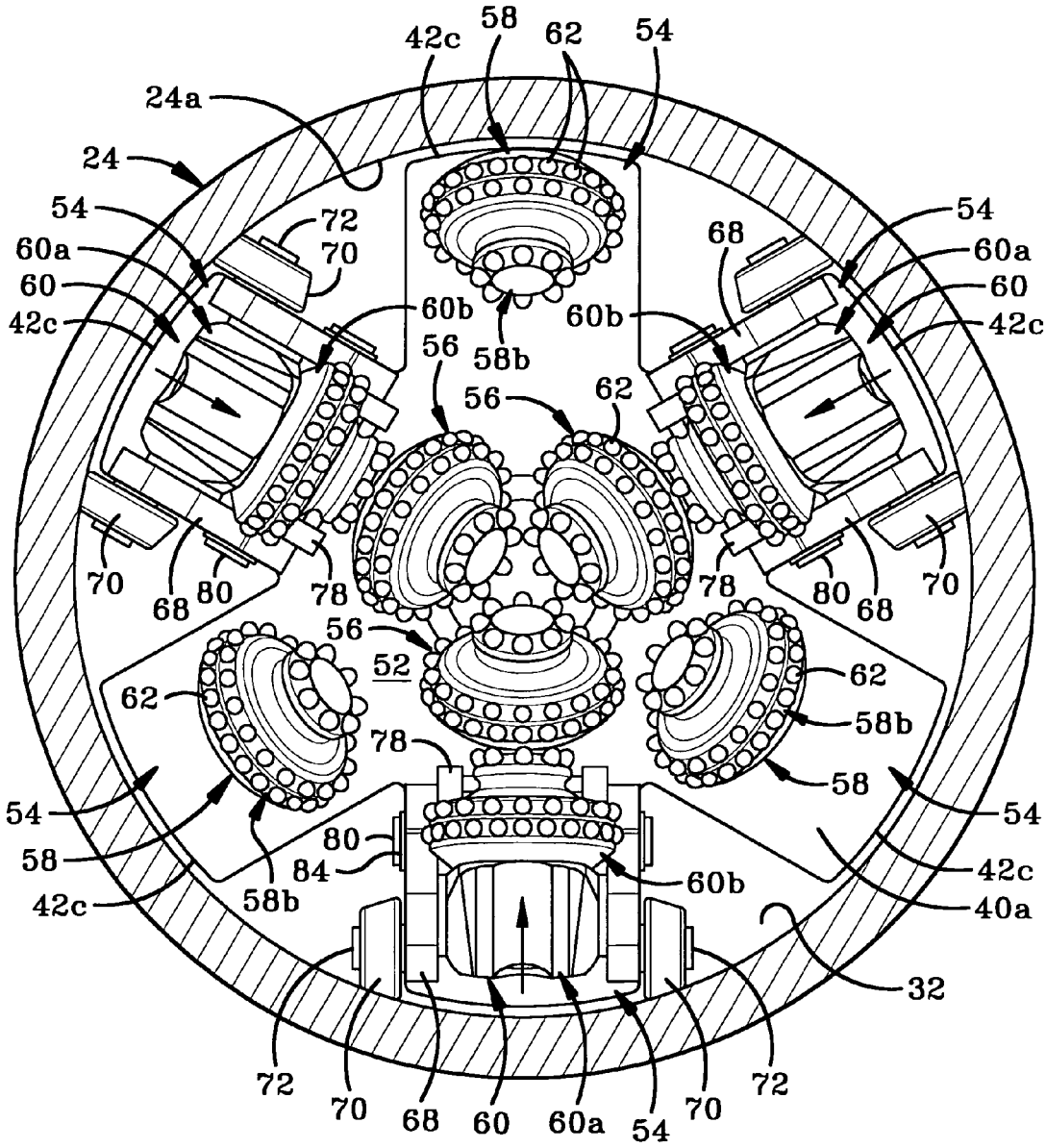
FIG. 7 is an end view of the rock head in the first position and contained within the bore of the pipe.
Figure 8:
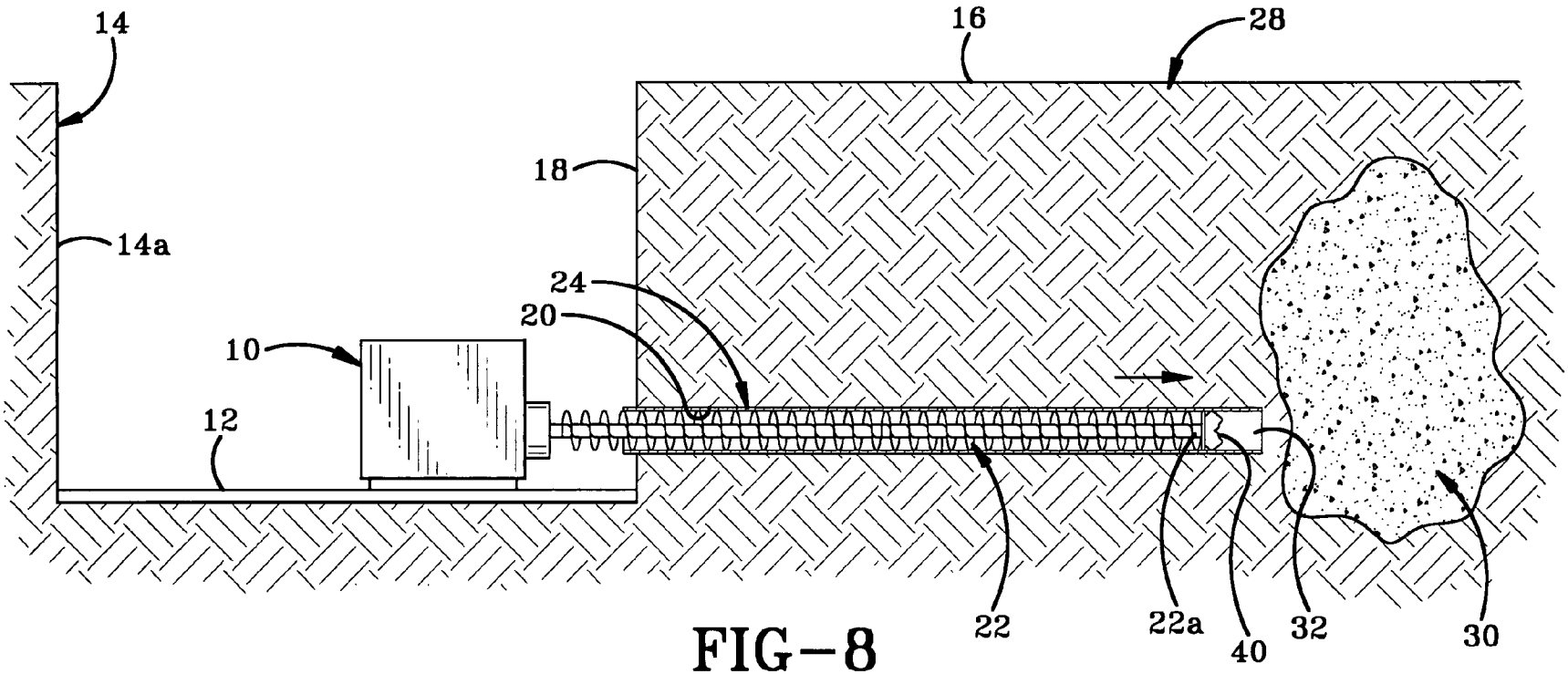
FIG. 8 is a front elevational view showing the boring machine moving the rock head and auger through the pipe toward engagement with the rock.
Figure 9:
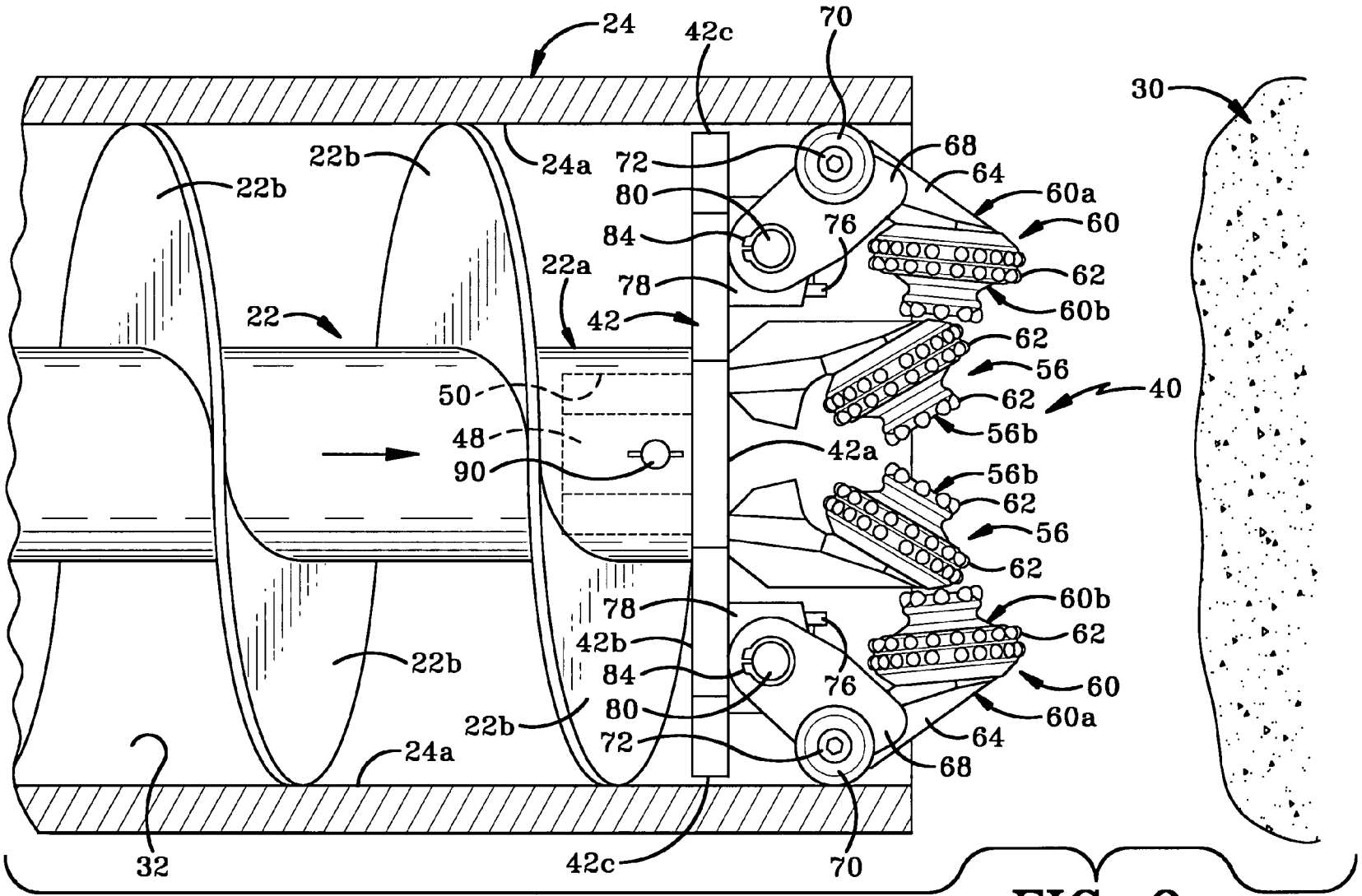
FIG. 9 is a partial cross-sectional front view of the front end of the pipe with the rock head about to emerge therefrom.
Figure 10:
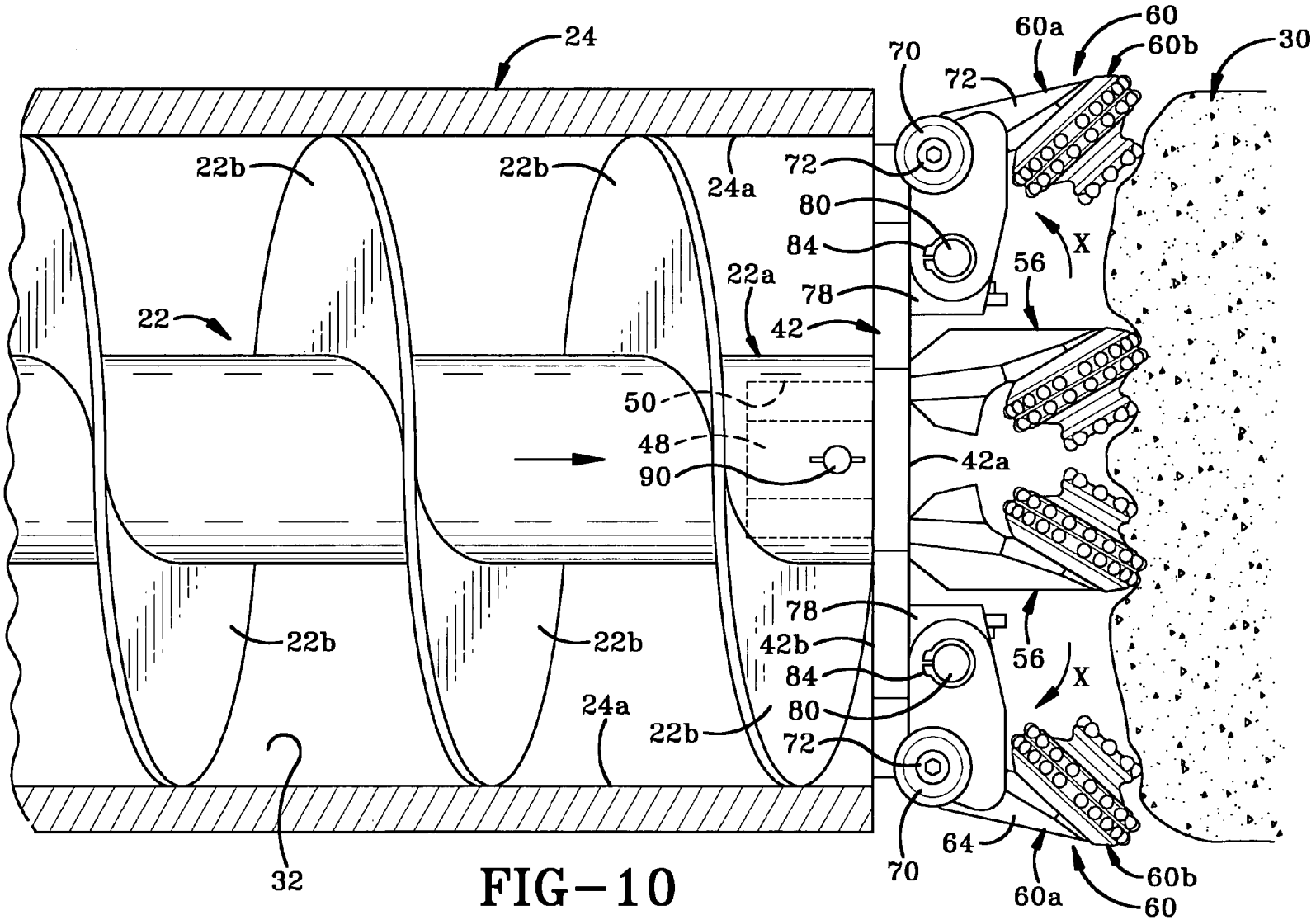
FIG. 10 is a partial cross-sectional front view of the front end of the pipe with the rock head extending out of the pipe, in the second position and in contact with the rock.

As boring machine 10 advances along tracks 12 toward soil-face 18, it causes auger 22 to move through pipe 24, pushing rock head 40 through the bore 32 thereof (FIG. 8). FIG. 7 shows the configuration of rock head 40 traveling through bore 32 of pipe 24. FIGS. 9 and 10 illustrate how the rock head exits pipe 24. It can be seen that while the wheels 70 remain in contact with interior surface 24*a*, the rock head 40 is in its first position with the roller cones 60*b* of drill bits 60 disposed proximate central region 52 of base 42, i.e., drill bits 60 are in a compressed position. As soon as wheels 70 exit pipe 24, springs 82 rapidly return to their original shape and position, thus causing body 60*a* of each drill bit 60 to move outwardly as is indicated by the arrows "X" in FIG. 10. Rock head 40 returns to its fully opened second position where the drill bits 60 extend at least partially beyond the outermost edge 42*c* of base 42. In this position, rock head 40 can be used to bore through rock 30. This is accomplished by boring machine 10 rotating auger 22, which in turn rotates rock head 40.

Figure 11:
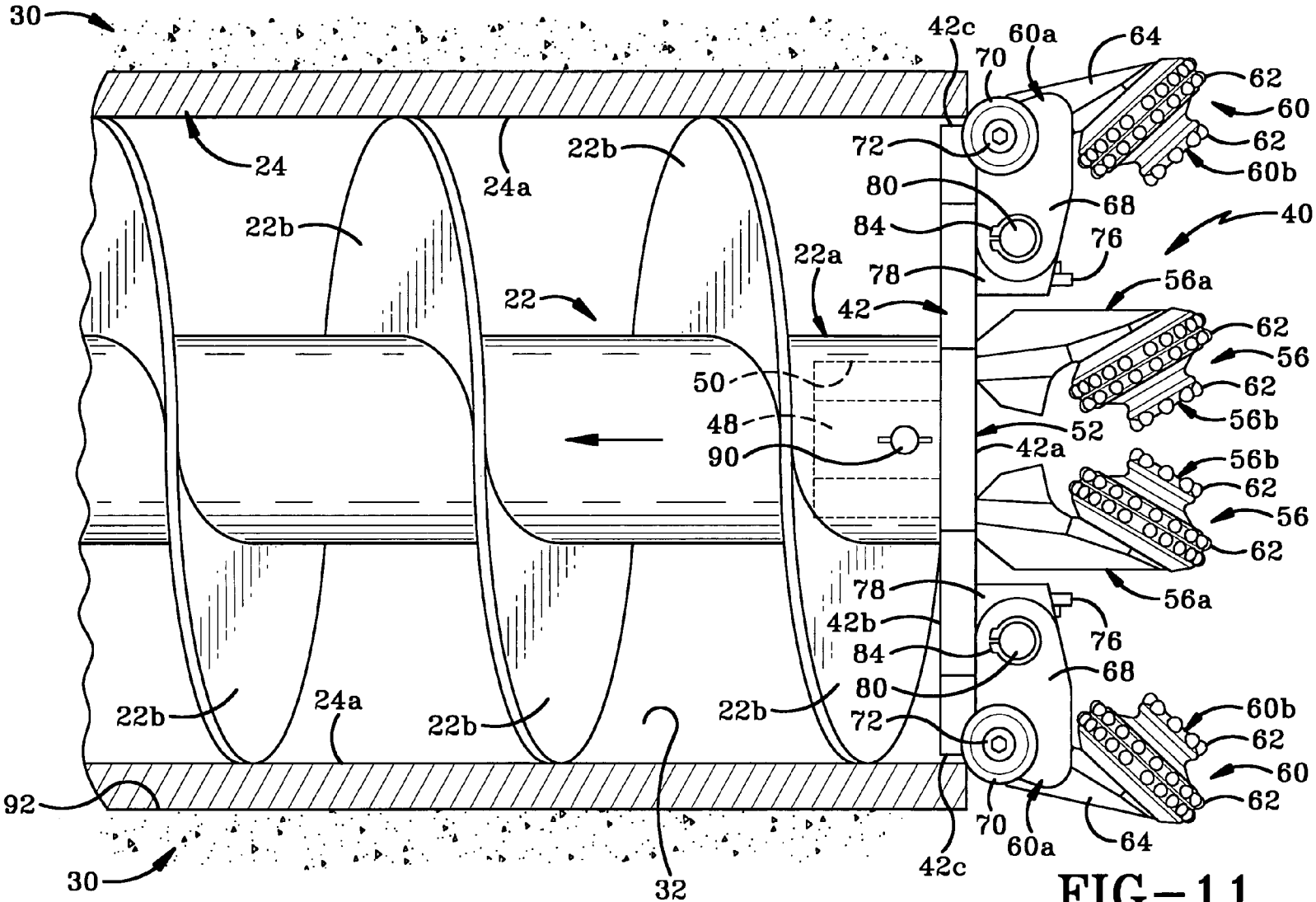
FIG. 11 is a partial cross-sectional front view of the front end of the pipe showing the rock head being withdrawn back into the pipe.
Figure 12:
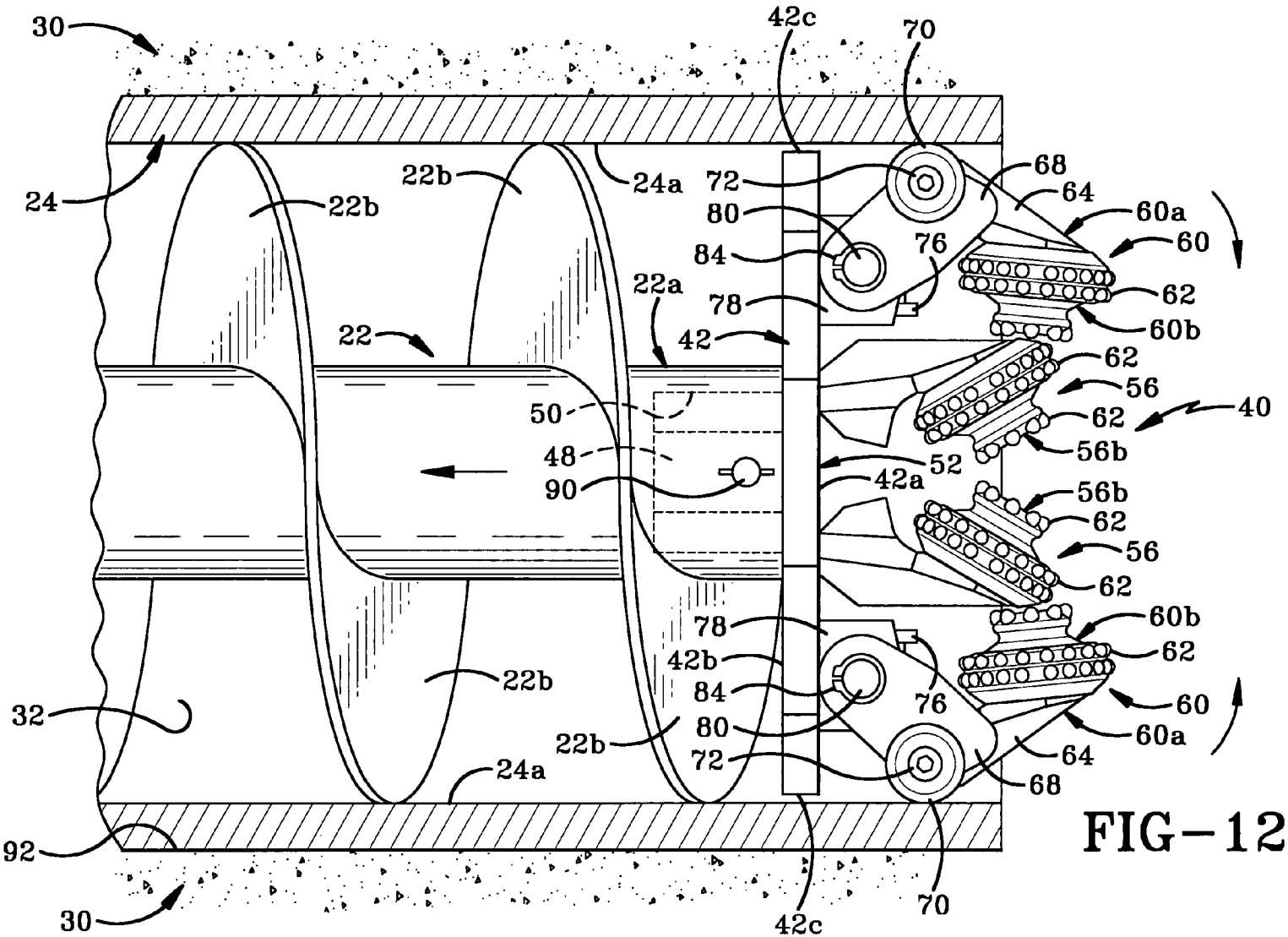
FIG. 12 is a partial cross-sectional front view of the front end of the pipe with the rolling roller cones camming against the front end of the pipe.

Referring to FIGS. 11 and 12, once a passageway 92 has been bored through rock 30, then rock head 40 has to be removed and replaced with a dirt head 26 to cut through the soil disposed on the far side of rock 30. In order to replace rock head 40, boring machine 10 is withdrawn along tracks 12 toward the back side 14*a* (FIG. 1) of excavation pit 14. This causes auger 22 and rock head 40 to be withdrawn back into bore 32 of pipe 24. As rock head 40 enters pipe 24, wheels 70 cam against the end of pipe 24, and slide into the bore 32, sliding against interior surface 24*a* of pipe 24. This camming action causes body 60*a* of drill bits 60 to pivot about retaining pins 80 and rotate inwardly toward central region 52 of base 42 (FIG. 12). This effectively reduces the outer diameter of rock head 40 so that it is able to fit within bore 32 of pipe 24. Auger 22 is withdrawn from pipe 24 and as rock head 40 exits pipe 24, drill bits 60 pivot about retaining pins 80 and rock head returns to its second position. The hex connectors 48, 50 are then detached from one another and rock head 40 may then be replaced with dirt head 26.

The springs 82 utilized in this device are manufactured to be strong enough to be compressed and expanded numerous times so that rock head 40 can be reused. Springs 82 are also sufficiently strong enough to withstand the rigors of boring through the rock.

It will be understood by those skilled in the art that rock heads in accordance with the present invention are sized to be used in conjunction with pipes of a defined range of internal diameters. Within that range of pipe diameters, the drill bits will pivot to a greater or lesser degree in order to be received within the bore of any one particular pipe. The drill bits do need to pivot to a degree sufficient to allow for forward or rearward motion of the rock head and auger through the pipe. If the fit is too tight so that travel through the pipe would be substantially hindered, then the boring company would employ a differently sized rock head in accordance with this invention. Consequently, the boring company would utilize a plurality of differently sized rock heads with a plurality of differently sized pipes.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A rock head for boring through rock; said rock head comprising;

a base having an outermost edge;

a connector carried by the base;

a plurality of movable mounts disposed on the base;

a roller cone for cutting rock carried by each movable mount;

a spring disposed between each movable mount and the base; whereby each roller cone is spring-biased and is movable between a first position wherein the roller cones are positioned inwardly of the outermost edge of the base; and a second position wherein the roller cones are positioned at least partially outwardly of the outermost edge of the base.

2. The rock head as defined in claim 1, wherein the movable mounts each include:

a leg onto which the roller cone is mounted;

a pair of spaced-apart side walls that flank said leg; and a front wall mounted to the leg and oriented toward a central region of the base; said front wall being disposed between the side walls.

3. The rock head as defined in claim 1, further comprising a plurality of mounting brackets disposed at spaced intervals on the front surface of the base; and wherein the movable mounts are each pivotally secured to one of the mounting brackets.

4. The rock head as defined in claim 3, wherein the mounting brackets are substantially U-shaped, each bracket having an inner wall and a pair of spaced-apart side walls.

5. The rock head as defined in claim 4, wherein each of the U-shaped mounting brackets are oriented so that the inner wall is disposed proximate the central region of the base and the side walls of the bracket extends outwardly away from the inner wall and toward the outermost edge of the base.

6. The rock head as defined in claim 4, wherein the side walls of each mounting bracket are spaced apart a distance sufficient to be received between the side walls of the movable mounts.

7. The rock head as defined in claim 6, wherein each of the side walls of the mounting bracket and the side walls of the associated movable mount define an aperture therein; and said apertures in the side walls of the mounting bracket and the side walls of the movable mounts are alignable.

8. The rock head as defined in claim 7, further comprising a plurality of retaining pins, each of said pins being sized to be received through the aligned apertures in the movable mounts and mounting brackets, and wherein the retaining pins secure the movable mounts and mounting brackets together.

9. The rock head as defined in claim 8, wherein each retaining pin includes a pair of spaced apart circumferential grooves; and wherein the rock head further comprises a plurality of snap rings; each snap ring being receivable within one of the circumferential grooves to secure the retaining pins within the aligned apertures.

10. The rock head as defined in claim 9, further comprising a plurality of wheels, and wherein at least one wheel is mounted to each movable mount; whereby the wheel is adapted to ride along an interior surface of a pipe as the rock head travels through a bore therein.

11. The rock head as defined in claim 10, further comprising a pin extending outwardly away from an exterior surface of at least one of the side walls of the movable mount; and wherein the wheel is mounted to the pin.

12. The rock head as defined in claim 1, wherein the base includes a central region and a plurality of wings radiating outwardly away from said central region; and wherein a gap is defined between each adjacent pair of wings; and wherein the movable mounts are disposed on alternate wings of said base.

13. The rock head as defined in claim 12, further comprising a plurality of fixedly mounted roller cones, said fixedly mounted roller cones being mounted onto the wings that alternate with the wings on which the movable mounts are disposed.

14. The rock head as defined in claim 13, further comprising a tri-cone set of roller cones fixedly mounted proximate the central region of the base of the rock head.

15. In combination;

a boring machine mountable on a plurality of tracks;

a flighted auger connectable at a first end to the boring machine; whereby said boring machine is activated in a first direction to rotate and advance said auger toward a soil-face to be bored, and in a second direction to retract said auger away from the soil-face;

an elongated pipe having an internal bore through which said auger is inserted; and wherein said boring machine advances said pipe along with said auger;

a dirt head selectively connectable to a second end of the auger and adapted to bore through soil encountered beyond said soil-face;

a rock head selectively connectable to the second end of the auger to replace said dirt head when rock is encountered beyond said soil-face; said rock head including a plurality of roller cones movably mounted to a base and adapted to bore through the rock; and wherein the roller cones move between a first position where they extend at least partially outwardly beyond an outermost edge of the base; and a second position where they are disposed inwardly of the outermost edge of the base; and when the roller cones are in the second position the rock head can travel through the bore of the pipe; and when the roller cones are in a first position, the rock head cannot travel through the bore of the pipe.

16. The combination as defined in claim 15, wherein the rock head includes a base onto which the plurality of movable roller cones are mounted; and a plurality of springs, each spring being disposed between the roller cones and the base, and wherein the springs are compressed when the roller cones are moved from the first position to the second position.

17. The combination as defined in claim 16, wherein each of the roller cones further includes at least one wheel that is positioned to ride along an interior surface of the pipe as the rock head is moved through the bore thereof.

18. The combination as defined in claim 17, wherein the base includes a central region and a plurality of wings radiating outwardly away from said central region; and wherein a gap is defined between each adjacent pair of wings; and wherein the movable mounts are disposed on alternate wings of said base.

19. The combination as defined in claim 18, further comprising a plurality of fixedly mounted roller cones, said fixedly mounted roller cones being mounted onto the wings that alternate with the wings on which the movable mounts are disposed.

20. The combination as defined in claim 19, further comprising a tri-cone set of roller cones fixedly mounted proximate the central region of the base of the rock head.

* * * * *